US007384023B2

(12) United States Patent
Plummer

(10) Patent No.: US 7,384,023 B2
(45) Date of Patent: Jun. 10, 2008

(54) CAPSTAN ANTI-REVERSING PAWL

(75) Inventor: Jeffrey Jay Plummer, Rockford, IL (US)

(73) Assignee: Greenlee Textron Inc., Rockford, IL (US)

( * ) Notice: Subject to any disclaimer, the term of this patent is extended or adjusted under 35 U.S.C. 154(b) by 262 days.

(21) Appl. No.: 11/443,597

(22) Filed: May 31, 2006

(65) Prior Publication Data

US 2007/0125993 A1 Jun. 7, 2007

Related U.S. Application Data

(60) Provisional application No. 60/742,837, filed on Dec. 6, 2005.

(51) Int. Cl.
*B21F 9/00* (2006.01)

(52) U.S. Cl. ..... 254/223; 254/357; 254/134.3 FT

(58) Field of Classification Search ..... 254/222, 254/223, 357, 376, 134 FT
See application file for complete search history.

(56) References Cited

U.S. PATENT DOCUMENTS

| | | | | |
|---|---|---|---|---|
| 3,112,816 | A * | 12/1963 | Halford | 254/391 |
| 5,415,377 | A * | 5/1995 | Britt et al. | 254/323 |
| 6,685,171 | B2 * | 2/2004 | Lob et al. | 254/391 |
| 6,742,770 | B1 * | 6/2004 | Vassioukevitch | 254/391 |
| 6,799,751 | B1 * | 10/2004 | Anderson | 254/223 |
| 6,837,357 | B2 * | 1/2005 | Peter | 192/219.4 |
| 7,198,219 | B1 * | 4/2007 | Alajajyan et al. | 242/247 |

* cited by examiner

*Primary Examiner*—Emmanuel M Marcelo
(74) *Attorney, Agent, or Firm*—Kurt J. Fugman

(57) ABSTRACT

An anti-reversing pawl mechanism is claimed that includes a pawl that is engaged by a flexible coupling but that is also biased toward a driven member such that when the engagement of the flexible coupling is removed, the pawl engages the driven member and stops it from moving.

20 Claims, 3 Drawing Sheets

CAPSTAN ANTI-REVERSING PAWL

CROSS REFERENCE TO RELATED APPLICATIONS

The present application claims benefit of U.S. Provisional application Ser. No. 60/742,837 filed on Dec. 6, 2005.

BACKGROUND OF THE INVENTION

Cable pullers are used by electrical contractors to pull cables through pipe or conduit so that the cables can be terminated at either end. Once terminated, these cables can be used to supply power or data between locations. In particular, cables that supply power can require significant forces in order to be pulled. For this reason, cable pullers are used that typically comprise a motor that powers a drive sprocket, which then transmits torque to a capstan around which a pulling rope can be wound. It is often the case that a drive chain is the means used to connect the capstan to the drive sprocket so that the torque from the motor can be transmitted to the capstan. The capstan is configured to rotate in a primary direction during which the pulling rope is wrapped around the capstan, causing the wire or cable to be pulled through the conduit.

In use, the pulling rope is fished through the conduit by means commonly known in the art after it has been attached to the cable that is to be pulled. Once the cable puller is turned on, the motor causes the drive sprocket to rotate, which transmits its torque to another sprocket to which the capstan is connected by the drive chain. As the capstan begins to rotate, the pulling rope is wound around it such that the user can pull onto its tail end. This arrangement creates a great amount of mechanical advantage, aiding in pulling the cable through the conduit. During a cable pull, great amounts of force in the order of magnitude of thousands of pounds can be exerted on the components of the cable puller. Consequently, these parts can become stressed and can be damaged or broken, including the drive chain. If the drive chain should break, it is very undesirable that the capstan should rotate in a direction that is opposite to the primary direction for a host of reasons including safety.

For this reason, an anti-reversing pawl is often employed such that if the capstan should rotate in the wrong direction, the pawl will engage the capstan and stop it from moving. Pawl mechanisms that have been previously employed are needlessly complex and require too much time to assemble, making them costly. In addition, they often continuously engage the teeth that are part of the sprocket that drives the capstan, which is an ineffective method for pulling rope when the capstan is operating at high speeds because of the drag it creates on the sprocket. Another drawback of this design is that it creates a significant amount of noise as the pawl engages each individual tooth of the sprocket. Yet another drawback is that there is wear on the part of the pawl that engages the sprocket, which could adversely affect the manner in which the pawl engages the sprocket when it needs to prevent the capstan from reversing its direction. Accordingly, there exists a need for an anti-reversing pawl mechanism that is simpler, cheaper, quieter, more robust, and that will work effectively at high speeds without creating unnecessary drag.

SUMMARY OF THE INVENTION

The present invention includes an anti-reversing pawl mechanism that includes a pawl, a drive member, a driven member, and a flexible coupling that is in communication with the drive member and driven member. The pawl is in contact with the flexible coupling and is biased toward the driven member such that if the pawl's engagement with the flexible coupling is removed, then the pawl will engage the driven member. This engagement may prevent the driven member from reversing its direction.

The present invention may also take the form of a cable pulling device with a capstan anti-reversing pawl mechanism. This mechanism comprises a frame, a motor that is attached to the frame, a drive member that is powered by the motor, a driven member, a flexible coupling that is in communication with the drive and driven members, and a capstan that is attached to the driven member. It further includes a pawl which is in contact with the flexible coupling and which is biased to engage the driven member if contact with the flexible coupling is removed. Preferably, this engagement will prevent the driven member from reversing its direction.

This invention also encompasses the following method for providing an anti-reversing pawl mechanism. One step is to provide a drive member, a driven member, and a flexible coupling that is in communication with both the drive member and driven member. Another step is to provide a pawl that is engaged by the flexible coupling and is capable of engaging the driven member. Yet another possible step is to bias the pawl toward engaging the driven member. The last possible step would be to remove the engagement between the flexible coupling and the pawl, allowing the pawl to engage the driven member.

DETAILED DESCRIPTION OF THE PREFERRED EMBODIMENT

Figure 1:
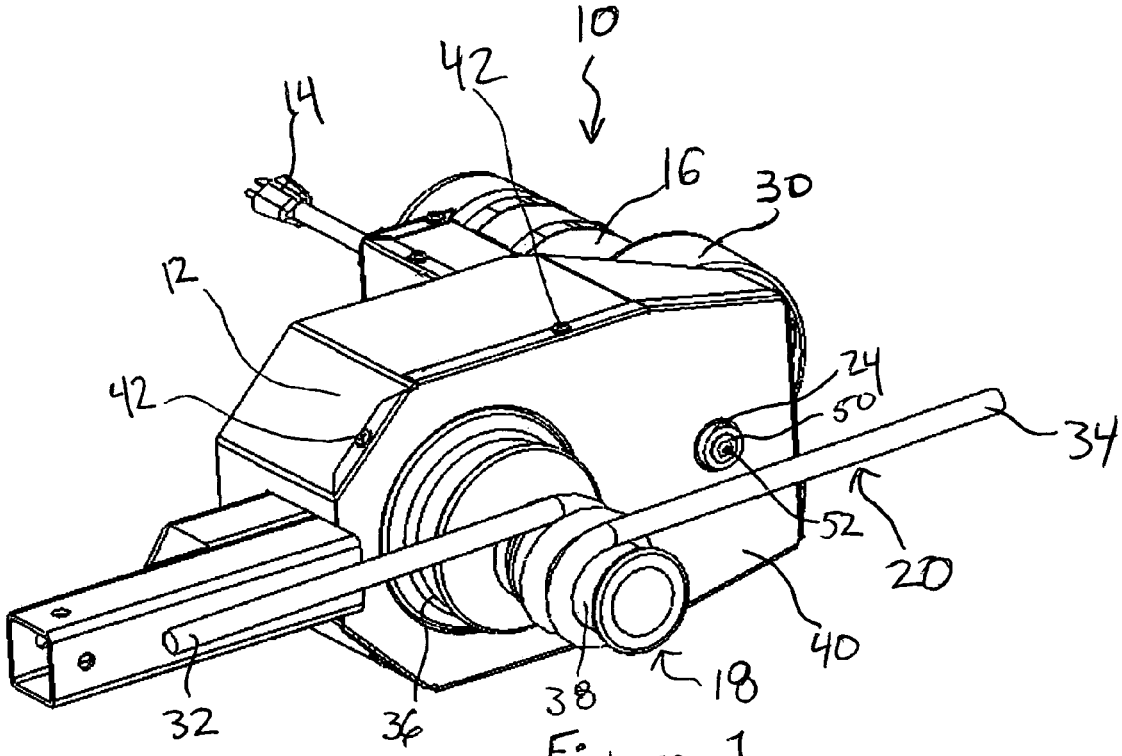
FIG. 1 is a perspective view of a cable puller employing the capstan anti-reversing pawl mechanism with a pulling rope wrapped around the capstan.
Figure 2:
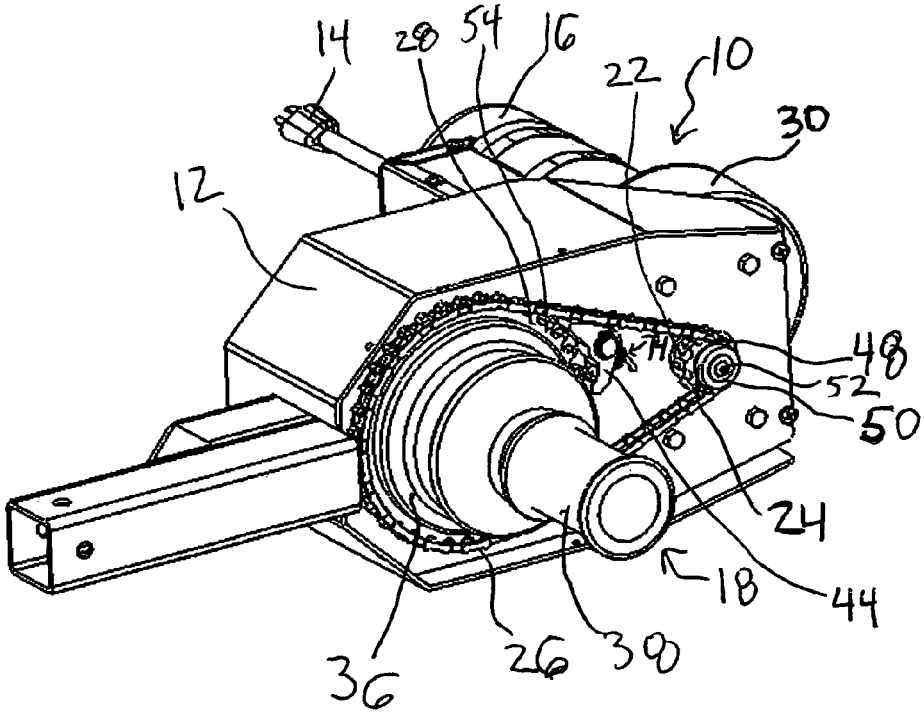
FIG. 2 is a perspective view of the cable puller of FIG. 1 with the pulling rope and chain guard removed.

Looking at FIGS. 1 and 2, there is shown the preferred embodiment of a cable pulling device 10 with a capstan anti-reversing pawl mechanism that satisfies the aforementioned need. It comprises, in part, a frame (only partially shown) 12, an electric plug 14, an electric motor 16, a capstan 18, and a pulling rope 20. In use, the electric plug 14 of the cable pulling device 10 is plugged into an electric outlet (not shown) and the activation switch (not shown) is placed into the "on" position. This causes the electric motor 16 to produce power, which is conveyed by a gear box 30 to a drive shaft 22 that has a first sprocket 24 attached to its end, both of which begin to rotate. A drive chain 26 connects the first sprocket 24 to a second sprocket 28, to which the capstan 18 is attached, such that both the capstan 18 and second sprocket 28 begin to rotate in a primary direction to aid in pulling a cable through conduit. The user wraps the pulling rope 20, whose front end 32 has been attached to the cable that needs to be pulled, around the rotating capstan 18 and pulls on its rear end 34, creating mechanical advantage in addition to that created within the internal workings of the cable pulling device 10, helping to create the force necessary to pull the cable through the conduit.

Closer inspection of the capstan 18 reveals the following structure. It includes a first cylindrical portion 36 that is next to the frame 12 and a second cylindrical portion 38 that extends from the first cylindrical portion 36 and that is concentric therewith. The first cylindrical portion 36 has a land length for wrapping the pulling rope around it that is less than the land length of the second cylindrical portion 38. Initially, the user will wrap the pulling rope 20 around the first cylindrical portion 36 to effectuate the pulling of the cable as quickly as possible. If the user feels that more torque is necessary to pull the cable, the user can simply wind the pulling rope over the second cylindrical portion 38, whose diameter is less than the diameter of the first cylindrical portion 36, to provide the additional mechanical advantage that is needed. Also, the increased land length of the second cylindrical portion 38 also allows the pulling rope 20 to be wrapped around it more, which also increases the mechanical advantage for pulling the cable.

As the cable is being pulled through the conduit, the pulling rope 20 will tend to stretch, storing great amounts of energy. The force required to perform the pull can cause the drive chain 26 to break or malfunction, allowing the capstan 18 to reverse its direction and release the energy stored in the pulling rope 20. This is undesirable as it could pose a safety hazard. Consequently, two safety precautions are provided to reduce this hazard if the drive chain 26 should break. First, a chain guard 40 is secured to the frame 12 of the pulling device 10 by screws 42 to keep the chain 26 restrained within the frame 12 of the cable pulling device 10. This prevents the chain 26 from catapulting and striking an object that is within the vicinity of the cable pulling device 10 if the chain 26 should break or malfunction. Second, a capstan anti-reversing pawl mechanism is employed to prevent the energy stored within the pulling rope 20 from being released. This mechanism is shown in FIG. 2, where the chain guard 40, screws 42 , and pulling rope 20 have been removed to more clearly show this mechanism and its relation to the cable pulling device 10 as a whole.

Figure 3:
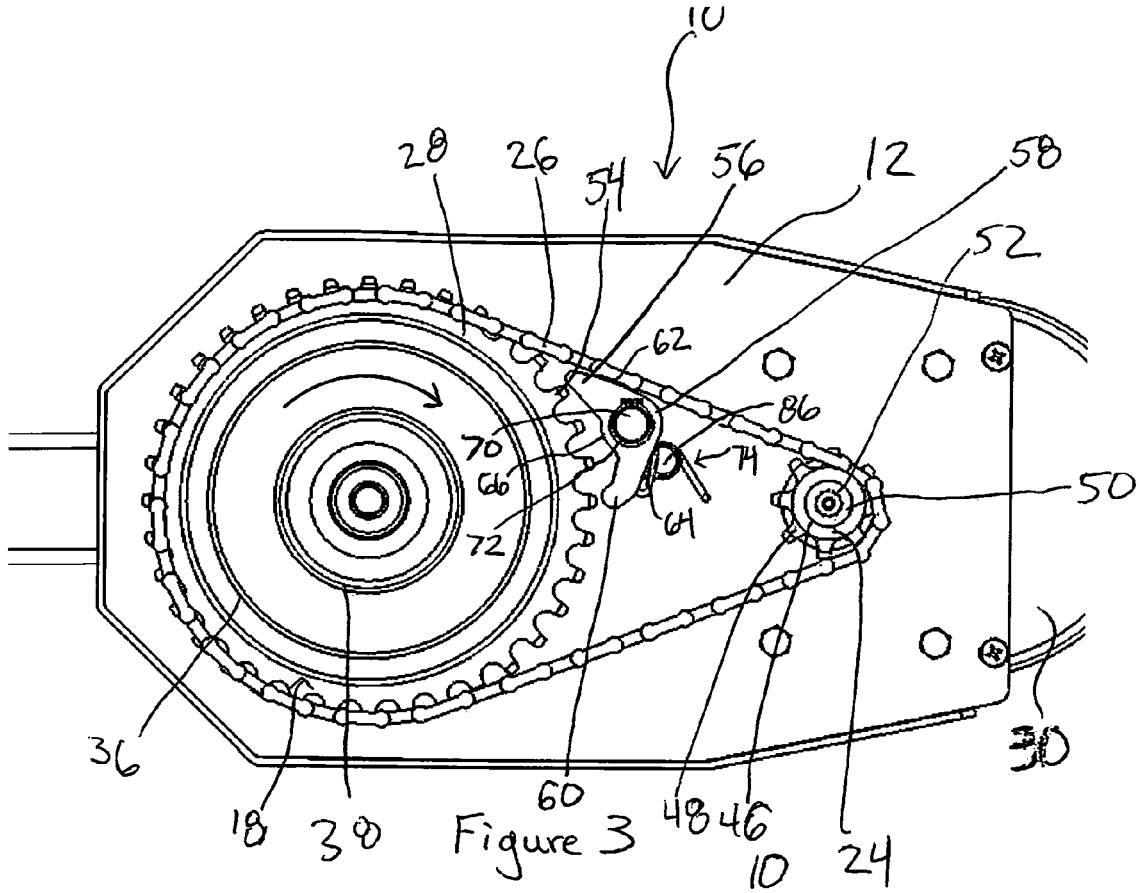
FIG. 3 is a side elevational view of the cable puller of FIG. 2 showing the capstan anti-reversing pawl mechanism with an unbroken chain.
Figure 4:
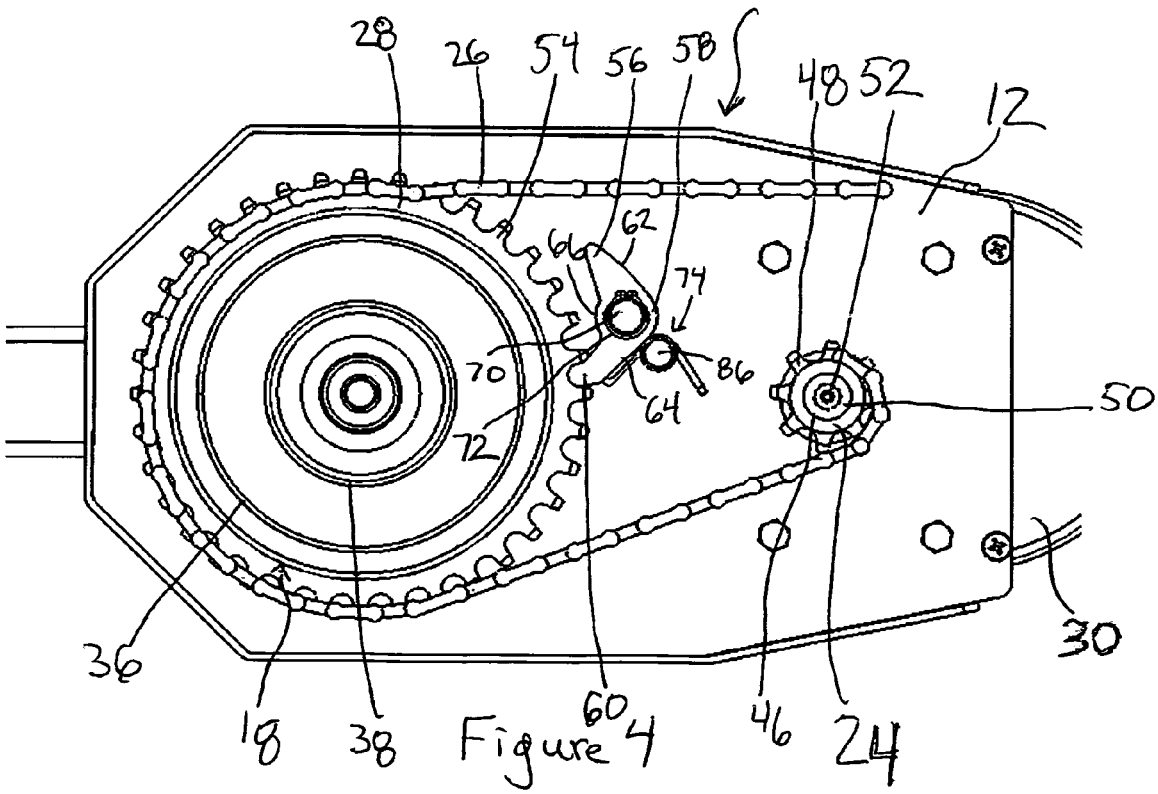
FIG. 4 is a side elevational view of the cable puller of FIG. 2 showing the capstan anti-reversing pawl mechanism with a broken chain.

The construction and operation of the capstan anti-reversing pawl mechanism can be best seen in FIGS. 3 and 4. It includes, in part, a drive shaft 22, a first sprocket 24, a drive chain 26, a second sprocket 28, a capstan 18 that is attached to the second sprocket 28, a torsion spring 74, and a pawl 44. The drive shaft extends through an aperture in the frame 12 of the cable pulling device 10. The first sprocket 24 has a central passageway 46 and a plurality of teeth 48 along its periphery. The first sprocket 24 is positioned such that its central passageway 46 is slid over the end of the drive shaft 22, and is secured to the drive shaft 22 by a washer 50 and screw 52.

The second sprocket 28 is freely rotatably mounted to the outside of the frame 12 such that the first and second sprocket members 24, 28 are co-planar. The second sprocket 28 has a plurality of teeth 54 around its periphery. The second sprocket 28 preferably has a larger diameter than the first sprocket 24 and more teeth along its periphery than the first sprocket 24. Preferably, the ratio of the diameter of the second sprocket 28 as compared to the first sprocket 24 is four and a half to one. This ensures that the capstan 18 can supply the mechanical advantage needed to pull the cable during a cable pull.

The drive chain 26 is a continuous chain member that is configured with gaps between its rollers, which allow the teeth 48 of the first sprocket 24 and the teeth 54 of the second sprocket 28 to fit therebetween. Thus, the first and second sprockets 24, 28 are positioned at a distance away from the outside of the frame 12 such that the drive chain 26 is able to fit around and engage the teeth 48, 54 of the first and second sprockets 24, 28, respectively. It is preferable to use a chain instead of a belt due to the speeds and forces necessary to effectuate the cable pull.

Figure 5:
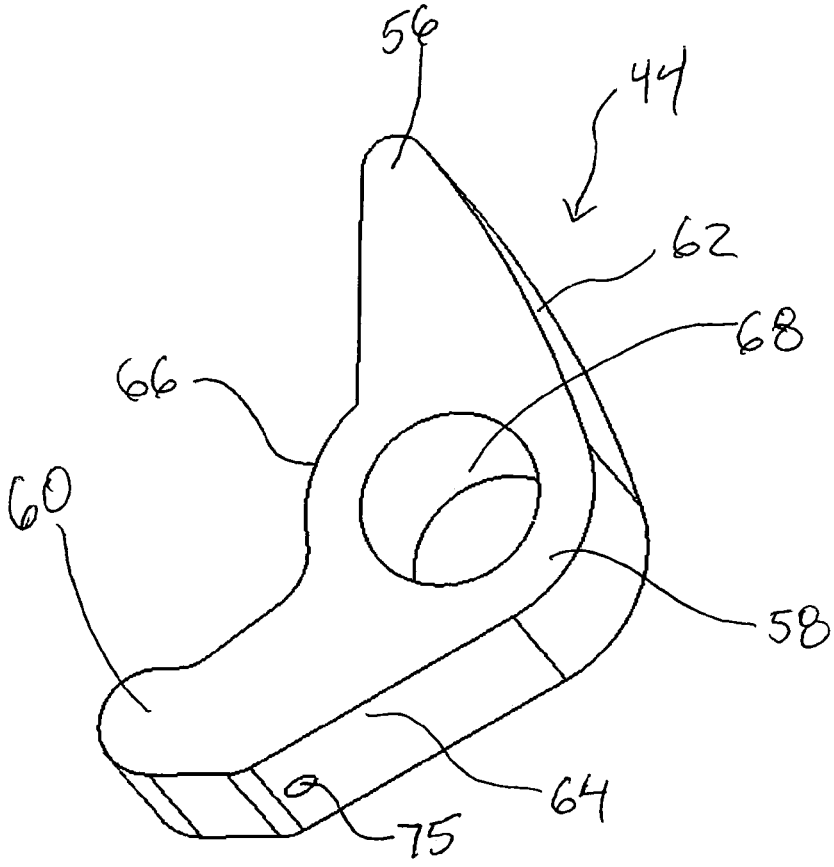
FIG. 5 is a perspective view of the pawl of the capstan anti-reversing pawl mechanism.

A pawl 44 is pivotally mounted to the outside of the frame 12 and is coplanar with the first and second sprockets 24, 28. The pawl 44 is positioned between the first and second sprockets 24, 28 but is close enough to the second sprocket 28 such that it can engage second sprocket 28 when appropriate. Looking at FIG. 5, the pawl 44 is a generally triangular block such that the pawl 44 has first, second and third corners 56, 58, 60 and first, second and third edges 62, 64, 66. The first side edge 62 extends between the first and second corners 56, 58. The second side edge 64 extends between the second and third corners 58, 60. Finally, the third side edge 66 extends between the first and third corners 58, 60. Each of the corners is generally rounded. The first side edge 62 is also preferably slightly rounded. The third corner 60 is configured such that the third corner 60 looks like a finger that can engage the teeth 54 of the second sprocket 28, as will be discussed in further detail below. The pawl 44 also includes a central hole 68 so that it can be slid onto a pin 70 and held into place by a c-clip 72. There is also a small hole 75 located along the second edge 64 proximate to the third corner 60 for receiving part of the torsion spring 74, which will be described in detail next.

Figure 6:
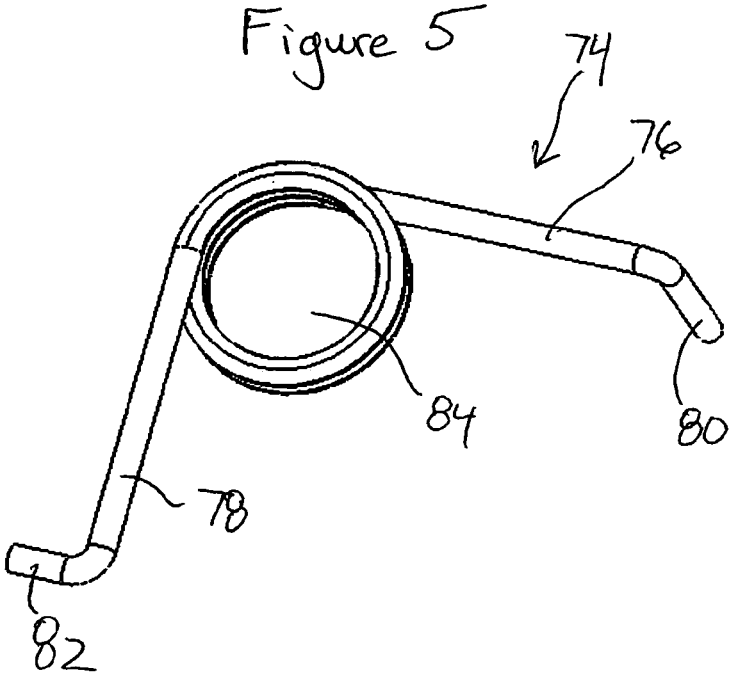
FIG. 6 is a perspective view of the torsion spring of the capstan anti-reversing pawl mechanism.

The torsion spring 74 is mounted to the outside of the frame 12 and is positioned between the pawl 44 and first sprocket 24, but is proximate to the pawl 44. The torsion spring 74 is formed of wire that is coiled along its length such that it has a first arm 76 and a second arm 78, which are perpendicular to each other (see FIG. 6). A first hook 80 extends down from the first arm 76 and is configured to engage a hole found on the frame 12 of the pulling device 10. A second hook extends from the second arm 78 and is coplanar with the hole 75 found on the second edge 64 of the pawl 44 such that it can be placed therein. The center 84 of the torsion spring 74 can be slid over a pin 86, thereby holding the spring 74 in place during operation of the capstan anti-reversal mechanism. When the spring 74 is in its normal position, with only a small preload force biasing the spring member, the spring 74 acts on the second side edge 64 of the pawl 44 such that the third corner 60 of the pawl 44 can engage the teeth 54 of the second sprocket 28.

During normal operation when the drive chain 26 is not malfunctioning or is unbroken, the capstan anti-reversing mechanism operates in the following manner as best seen in FIG. 3. The drive chain 26 is positioned such that drive chain 26 engages the first side edge 62 of the pawl 44, such that the force created by this contact overcomes the spring force exerted by the torsion spring 74, which is in a deflected state, ensuring that the third corner 60 of the pawl 44 is disengaged from the teeth 54 of the second sprocket 28. This, in turn, allows the capstan 18 and second sprocket 28 to rotate as powered by the motor 16 and first sprocket 24 in a primary or clockwise direction as shown. During this operation, the drive chain 26 maintains engagement with the first side edge 62 of the pawl 44, whose rounded configuration ensures that contact with the drive chain 26 is kept to a minimum, reducing friction. This helps to reduce the noise and drag that is created during a cable pull.

However, should the drive chain 26 break or somehow malfunction, as best illustrated in FIG. 4, the drive chain 26 would disengage from the first side edge 62 of the pawl 44, allowing the spring force of the torsion spring 74 to rotate the pawl 44 until its third corner 60 comes into contact with the teeth 54 of the second sprocket 28. At this point, the second sprocket 28 and capstan 18 become locked, ensuring that any energy stored in the pulling rope 20 will not be released when the capstan 18 rotates in a non-primary or counter clockwise direction. In this way, the cable pulling device 10 uses chain tension to prevent the pawl 44 from engaging the teeth 54 of the second sprocket 28. If the drive chain breaks 26, the pawl 44 is biased to engage the teeth 54 of the second sprocket 28 and stop it from reversing its direction.

As can be seen, this capstan anti-reversing pawl mechanism is configured such that reverse rotation of the capstan 18 (because of tension in the pulling rope 20) is prevented if the drive chain 26 breaks or malfunctions. The preferred embodiment is especially useful for high-speed cable pullers that operate at speeds that are too fast for mechanisms that employ pawls that are always in contact with the teeth of a sprocket member. It also provides for a reduction in noise over the prior art where high pulling speeds are desired, and further provides for reduced wear on the pawl in the area critical for preventing the reverse rotation of the capstan. Of course, those with ordinary skill in the art will be able to make modifications to this preferred embodiment. For example, it is possible to substitute a belt, a first sheave with a groove on its rim for engaging the belt, and a second sheave with a groove on its rim for engaging the belt instead of using the chain, first sprocket, and second sprocket of the preferred embodiment. Therefore, the scope of this invention should be interpreted in view of the attached claims.

What is claimed is:

1. An anti-reversing pawl mechanism comprising:

a drive member;

a driven member;

a flexible coupling that is in communication with said drive member and said driven member; and a pawl which is in engagement with the flexible coupling and which is biased to engage the driven member if engagement with the flexible coupling is removed.

2. The anti-reversing pawl mechanism of claim 1 wherein the flexible coupling is a drive belt that is in communication with the first drive member and with the driven member.

3. The anti-reversing pawl mechanism of claim 2 wherein the drive member is a first sheave having a groove on its rim and the driven member is a second sheave having a groove on its rim, and said communication between the drive belt and the first sheave and the second sheave is accomplished by having the drive belt seated within the grooves of the first and second sheaves.

4. The anti-reversing pawl mechanism of claim 1 wherein the flexible coupling is a drive chain with gaps between its rollers.

5. The anti-reversing pawl mechanism of claim 4 wherein the drive member is a first sprocket with teeth along its periphery and the driven member is a second sprocket with teeth along its periphery, and said communication between the drive chain and the first and second sprockets is accomplished by placing the teeth of both sprockets within the gaps between the rollers of the drive chain.

6. A cable pulling device with an anti-reversing pawl mechanism comprising:

a frame;

a motor that is attached to the frame;

a drive member that is powered by the motor;

a driven member;

a flexible coupling that is in communication with said drive member and said driven member;

a capstan that is attached to the driven member; and a pawl which is in engagement with the flexible coupling and which is biased to engage the driven member if engagement with the flexible coupling is removed.

7. The cable pulling device with an anti-reversing pawl mechanism of claim 6 wherein the drive member is a first sheave with a groove on its rim and the driven member is a second sheave with a groove on its rim.

8. The cable pulling device with an anti-reversing pawl mechanism of claim 7 wherein the flexible coupling is a drive belt, and said communication between the drive belt and the first sheave and the second sheave is accomplished by having the drive belt seated within the grooves of the first and second sheaves.

9. The cable pulling device with an anti-reversing pawl mechanism of claim 6 wherein the drive member is a first sprocket with teeth on its periphery and the driven member is a second sprocket with teeth on its periphery.

10. The cable pulling device with an anti-reversing pawl mechanism of claim 9 wherein the flexible coupling is a drive chain with gaps between its rollers, and said communication between the drive chain and the first and second sprockets is accomplished by placing the teeth of both sprockets within the gaps found between the rollers of the drive chain.

11. The cable pulling device with an anti-reversing pawl mechanism of claim 10 wherein the diameter of the second sprocket is larger than the diameter of the first sprocket, thereby providing mechanical advantage.

12. The cable pulling device with an anti-reversing pawl mechanism of claim 11 wherein the capstan that is attached to the second sprocket has a first cylindrical portion with a first diameter and a second cylindrical portion that extends from the first cylindrical and is concentric therewith, the second cylindrical portion also having a second diameter that is less than the first diameter of the first cylindrical portion.

13. The cable pulling device with an anti-reversing pawl mechanism of claim 12 wherein the land length of the first cylindrical portion of the capstan is less than the land length of the second cylindrical portion of the capstan.

14. The cable pulling device with an anti-reversing pawl mechanism of claim 10 wherein the pawl is a substantially triangular shaped member that is pivotally connected to the frame and that has a slightly round surface that contacts the drive chain and also has a finger portion that is configured to engage one of the teeth of the second sprocket.

15. The cable pulling device with an anti-reversing pawl mechanism of claim 14 which further comprises a torsion spring that biases the pawl toward the second sprocket.

16. The cable pulling device with an anti-reversing pawl mechanism of claim 6 which further comprises a spring that biases the pawl toward the driven member.

17. The cable pulling device with an anti-reversing pawl mechanism of claim 16 wherein the spring is a torsion spring.

18. The method of providing a pawl mechanism, comprising the following steps:

providing a drive member, a driven member, a flexible coupling that is in communication with both the drive member and driven member; and providing a pawl that is engaged by the flexible coupling and is capable of engaging the driven member.

19. The method of claim 18 further comprising the step of biasing the pawl toward the driven member.

20. The method of claim 19 further comprising the step of removing the engagement of the flexible coupling from the pawl, causing the pawl to engage the driven member.

* * * * *